United States Patent [19]

Kimondo

[11] Patent Number: 4,674,988

[45] Date of Patent: Jun. 23, 1987

[54] TWIRLING BREAK-DANCING TOY DEVICE

[76] Inventor: Robertson Kimondo, 6326 Victoria Ave., Los Angeles, Calif. 90043

[21] Appl. No.: 785,223

[22] Filed: Oct. 7, 1985

[51] Int. Cl.[4] ..... A63H 3/00

[52] U.S. Cl. ..... 446/236; 446/359

[58] Field of Search ..... 446/359, 330, 351, 352, 446/358, 137, 138, 139, 236, 233, 234, 246, 268

[56] References Cited

U.S. PATENT DOCUMENTS

| | | | |
|---|---|---|---|
| 532,678 | 1/1895 | Martin | 446/138 |
| 1,389,372 | 8/1921 | Mitera | 446/236 |
| 2,767,517 | 10/1956 | Hooper | 446/139 |
| 3,100,365 | 8/1963 | Stalder | 446/236 |
| 3,672,092 | 6/1972 | Tepper et al. | 446/359 |

FOREIGN PATENT DOCUMENTS

| | | | |
|---|---|---|---|
| 10323 | of 1913 | United Kingdom | 446/359 |
| 467679 | 6/1937 | United Kingdom | 446/268 |

*Primary Examiner*—Mickey Yu

*Attorney, Agent, or Firm*—Milton S. Gerstein

[57] ABSTRACT

A toy for rotating or twirling a doll to simulate break-dancing. A main housing mounts a rotatable shaft having an upper portion that projects outwardly of the housing. A coupling element is secured to the projecting portion of the shaft, which coupling portion mates with a coupling element provided on a portion of an articulated doll. The shaft is rotatable by a disc, or fly-wheel, concentrically mounted about the shaft in the housing. A slot in a side edge surface of the housing allows for the insertion of a thumb or finger into the interior of the housing to thereby spin or rotate the disc, and therefore the doll.

2 Claims, 7 Drawing Figures

TWIRLING BREAK-DANCING TOY DEVICE

BACKGROUND OF THE INVENTION

The present invention is directed to a device for rotating a doll, or the like, for simulating break-dancing routines. The aim of the present invention is to allow a doll-sized figurine to be twirled or rotated at selected locations of the doll, such that upon rotation simulated break-dancing movements can be achieved.

Examples of dancing dolls or figurines are shown in the following U.S. Pat. Nos.: 1,898,735—McGee; 2,467,040—King; 2,592,669—Dyer; 2,932,918—Pearson, et al.; and 3,990,178—Stephens.

SUMMARY OF THE INVENTION

The main objective of the present invention is to provide a device for rotating a doll or figurine to simulate break-dancing.

It is another objective of the present invention to provide such a device that will allow the rotation of the doll in a plurality of positions.

It is still another objective of the present invention to allow for such rotation by the simple application of a force exerted by a thumb, or finger.

Towards these and other ends, the device of the present invention includes a hollow box having an extended, open slot formed in one of the side edge surfaces of the hollow box, which allows access into the interior of the box. The interior of the box rotatably mounts a manually-rotatable disc or fly-wheel. The fly-wheel rotates in a horizontal plane, together with a vertically-oriented shaft extending through the central portion of the disc. The upper portion of the vertical shaft projects upwardly and outwardly of the upper surface face of the hollow box. Attached to this projecting portion of the shaft is a mount for securing thereto a portion of a doll or figurine, for conjoint rotation. The manner by which the connection is made between the projecting shaft portion and a respective portion of the doll may be realized by a plurality of embodiments.

BRIEF DESCRIPTION OF THE DRAWING

The invention will be more readily understood with reference to the accompanying drawing, wherein.

DETAILED DESCRIPTION OF THE INVENTION

Figure 1:
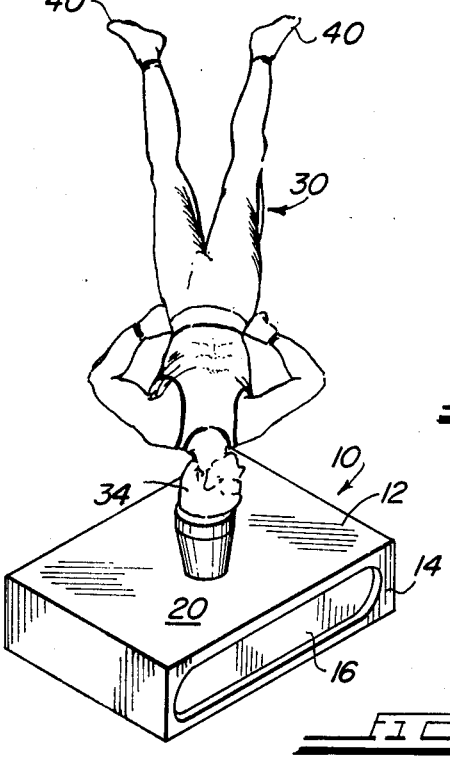
FIG. 1 is a perspective view showing the break-dancing toy of the present invention.
Figure 2:
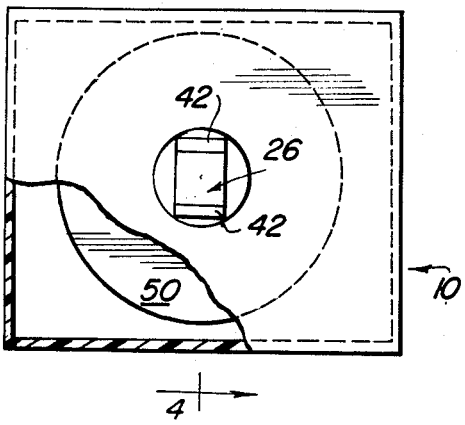
FIG. 2 is a top plan view of the break-dancing toy of the present invention, with the doll thereof removed, in partial cross-section.
Figure 3:
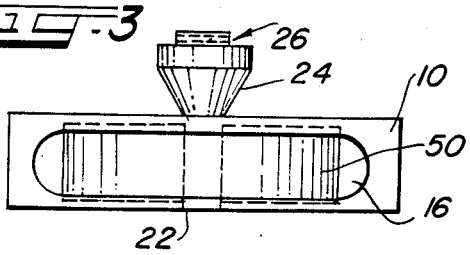
FIG. 3 is a side elevational view of the device of FIG. 1, showing the finger-opening thereof.
Figure 4:
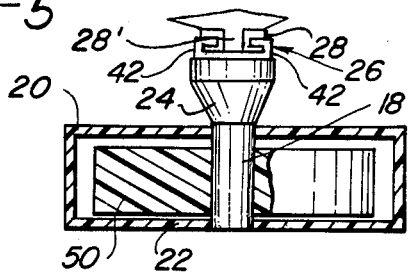
FIG. 4 is a cross-sectional view taken along line 4—4 of FIG. 2.
Figure 5:
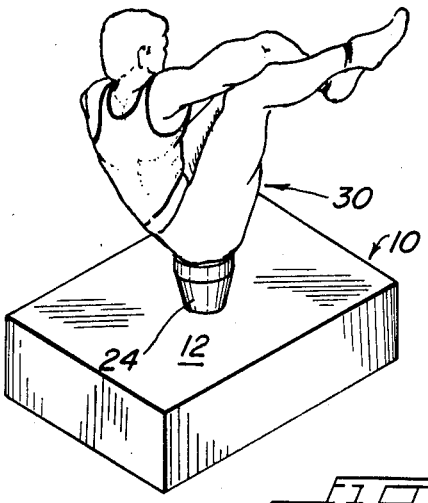
FIG. 5 is a perspective view showing the device of the present invention positioning a doll thereon in another break-dancing simulation.

Referring now to the drawings in greater detail, the break-dancing toy of the present invention is indicated generally by reference numeral 10. The device includes hollow box-shaped housing 12. One side edge surface 14 is provided with an elongated slot or opening 16, as shown in FIG. 1. The hollow interior of the housing 12 mounts a vertically-oriented shaft 18 by a pair of bearings provided in the upper and lower faces 20 and 22 thereof. The bearings are conventional, and such may be discarded, with simple circular openings being used. The upper portion of the shaft 18 projects outwardly of the upper surface 20 through a hole formed in the central portion of the upper surface 20, as can be seen in FIGS. 3 and 4. This upper portion 24 of the shaft 18 is generally frustro-conical in shape, and has affixed to its upper-most edge a coupling member 26 used for mating with corresponding coupling member 28 attached to a portion or portions of a doll 30.

The doll 30 is provided with a plurality of coupling elements 28 at portions thereof about which it is to be rotated. For example, a coupling element 28 is affixed to the head portion 34 of the doll, as shown in FIG. 1, and to the buttocks portion 38 of the doll. Also, these coupling elements 28 may also be affixed to the feet portions 40 of the doll. Each coupling element 28 is a square-shaped or rectangular-shaped thin plate projecting slightly from the respective portion to which it is connected by a rib 28', or the like, such that the thin plate may be slid into the opening formed by the bracket members 42 of the coupling member 26. The bracket members do not meet at the top thereof to thus provide a slot in which the rib 28' may slide in order to mount and dismount the doll.

The shaft 18 is rotated by a disc or fly-wheel 50, which disc has a central, vertical passageway for the insertion therethrough of the shaft 18, as shown in FIG. 4. The shaft 18 and the disc 50 may be coupled or connected to each other by any conventional manner. In the preferred embodiment, the disc 50 is made of a flexible, resilient thermoplastic, such that the passageway for the shaft is caused to be enlarged upon the insertion of a shaft therein. Toward this end, the shaft 18 may be tapered to enhance the enlargement of the passageway, and to thus snuggly fit therein without ready removal therefrom, owing to the friction between the outer surface of the shaft and the interior surface of the disc in a forced-fit type manner.

It may therefore be seen that upon rotation of the disc or fly-wheel 50, the shaft 18 is rotated therewith, to thus rotate the doll or figurine 30. The fly-wheel 50 is easily rotated manually by a thumb or finger inserted through the slot 16. The speed at which it rotates is, of course, variable. The doll 30 is a conventional doll that is capable of being articulated at the joints thereof, and the like. A "Gumby" doll is such an example, though it may be any conventional doll capable of being articulated such that it may take any number of configurations, such that it may be twirled by the present invention to simulate the rotation or of a break-dancer.

Figure 6:
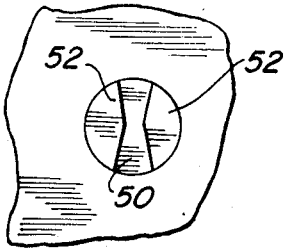
FIG. 6 is a partial top view showing a modification of the mount for securing a doll-portion to the rotating shaft.
Figure 7:
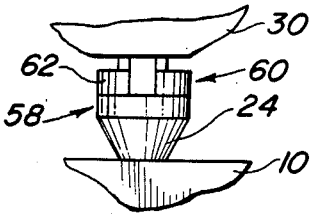
FIG. 7 is a side view showing the modification of FIG. 6.

In a modification of the coupling between the shaft 18 and the doll 30, magnetic connections may be used instead, as shown in FIGS. 6 and 7. In this modification, the projecting portion of the shaft is provided with a coupling member 50 which includes a pair of upwardly projecting shells 52, properly magnetized. The portions of the doll 30 having attached thereto a mating coupling element are provided with similarly shaped couplers 60 having mating shells 62, also being made of magnetizable material for secure connection with the coupling element 50 along corresponding shells 52 and 62.

While a specific embodiment of the invention has been shown and described it is to be understood that numerous changes and modifications may be made therein without departing from the scope, intent, and spirit of the invention as set out in the appended claims. For example, the upper surface 20 may be removably connected to the rest of the housing 10 so as to allow easy access to the interior of the housing, in order to fix or replace the moving parts thereof. Further, other coupling means may be utilized in addition to those above-disclosed. Preferably the disc 50 is made of a material of sufficient weight to sustain the prolonged rotation thereof upon the application of a torque by a thumb or finger of a hand.

What is claimed is:

1. A toy for twirling an articulated doll, comprising:

a main housing having a hollow interior for mounting parts thereof;

a shaft rotatably mounted in said main housing, said housing having an aperture formed in one of its surfaces thereof through which projects a projecting portion of said shaft;

a disc having a central passageway for the insertion therethrough of said shaft, said shaft and said disc being coupled together for conjoint rotation, said disc having a diametric expanse substantially greater than said shaft, so that upon rotation of said disc by a manually-applied torque said disc prolongs said conjoint rotation;

said housing having an elongated slot formed in one of the side surfaces thereof, said side surface lying in a plane perpendicular to a plane containing therein said surface through which said projecting portion of said shaft projects, whereby access to said disc is attainable by a thumb or finger to cause rotation thereof;

a first coupling means fixably attached to the uppermost portion of said projecting portion of said shaft;

an articulable doll having a plurality of cooperating second coupling means for selective coupling to said first coupling means so that said articulable doll may be attached to said shaft at different portions thereof;

said articulable doll comprising a plurality of articulated body-members including a head portion and a buttocks portion so that said articulable doll may be configured to that state most resembling the break-dancing routine being simulated, one said second coupling means being attached to said head portion of said doll, and one said second coupling means being attached to said buttocks portion of said doll, whereby different break-dancing routines may be simulated.

2. The toy according to claim 1, wherein said disc is made of a flexible plastic material; said shaft being tapered downwardly in a direction from said one surface towards said diametrically opposed surface; said tapered shaft being forced-fitted in said central passageway of said disc, to thereby achieve said conjoint rotation.

* * * * *